US007460925B2

(12) United States Patent
Noguchi

(10) Patent No.: US 7,460,925 B2
(45) Date of Patent: Dec. 2, 2008

(54) EMBROIDERY SEWING MACHINE

(75) Inventor: Yasukazu Noguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/713,032

(22) Filed: Mar. 2, 2007

(65) Prior Publication Data

US 2007/0204781 A1 Sep. 6, 2007

(30) Foreign Application Priority Data

Mar. 2, 2006 (JP) ..... 2006-056087

(51) Int. Cl.
*D05C 5/02* (2006.01)

(52) U.S. Cl. ..... 700/138; 700/136; 112/102.5; 112/103; 112/470.06; 112/470.18

(58) Field of Classification Search ..... 700/130, 700/136, 138; 112/102.5, 103, 168, 258, 112/312, 470.01, 470.06, 470.18, 470.19
See application file for complete search history.

(56) References Cited

U.S. PATENT DOCUMENTS 4,372,237 A * 2/1983 Totino et al. ..... 112/308
4,998,489 A * 3/1991 Hisatake et al. ..... 112/103
5,040,476 A * 8/1991 Takenoya et al. ..... 112/102.5
5,083,069 A * 1/1992 Jimenez et al. ..... 318/558
5,228,403 A * 7/1993 Sugimoto ..... 112/470.06
5,666,894 A * 9/1997 Jonsson et al. ..... 112/103
5,826,526 A * 10/1998 Tomita ..... 112/102.5
5,865,134 A * 2/1999 Okuyama et al. ..... 112/102.5
5,868,088 A * 2/1999 Mori et al. ..... 112/102.5
6,170,415 B1 * 1/2001 Inoue et al. ..... 112/163
6,237,516 B1 * 5/2001 Wakayama ..... 112/102.5
6,293,212 B1 * 9/2001 Ebata et al. ..... 112/103
6,298,276 B1 * 10/2001 Iida ..... 700/138
6,439,142 B2 * 8/2002 Ebata et al. ..... 112/102.5
6,641,598 B2 * 11/2003 Shimizu et al. ..... 112/302
6,802,272 B2 * 10/2004 Ebata et al. ..... 112/102.5
6,820,565 B1 11/2004 Kawaguchi et al.

FOREIGN PATENT DOCUMENTS

JP B2 3547496 7/2004
JP A 2004-254987 9/2004

* cited by examiner

*Primary Examiner*—Gary L Welch
*Assistant Examiner*—Nathan E Durham
(74) *Attorney, Agent, or Firm*—Oliff & Berridge, PLC

(57) ABSTRACT

An embroidery sewing machine includes an embroidery frame, a carriage transferring the embroidery frame, a drive unit moving the carriage, a sewing machine motor, a control unit controlling the drive unit and the motor so that an embroidery sewing mode is executed in which an embroidery pattern is sewn or a manual-feed sewing mode is executed in which a sewing operation is carried out with manual cloth feed while the carriage is moved to and held at a predetermined evacuative position, a foot controller, a connecting part connecting the foot controller to the control unit, and a mode switching unit which selectively switches between the embroidery sewing mode and the manual feed sewing mode. The mode switching unit switches to the embroidery sewing mode when the foot controller is non-connected to the connecting part, and to the manual-feed sewing mode when the foot controller is connected to the connecting part.

11 Claims, 12 Drawing Sheets

EMBROIDERY SEWING MACHINE

CROSS-REFERENCE TO RELATED APPLICATIONS

This application is based upon and claims the benefit of priority from the prior Japanese Patent Application No. 2006-56087 filed on Mar. 2, 2006, the entire contents of which are incorporated herein by reference.

BACKGROUND

1. Technical Field

The present invention relates to an embroidery sewing machine which can carry out embroidery sewing on workpiece cloth set on an embroidery frame based on embroidery data of embroidery pattern and a quilting sewing by free motion without using the embroidery frame.

2. Description of the Related Art

Embroidery sewing machines comprising a carriage and an embroidery frame have conventionally been used widely. The embroidery frame is attached to the carriage to hold workpiece cloth to be sewn. The carriage and the embroidery frame are moved so that a desired embroidery pattern is formed on the workpiece cloth. The embroidery sewing machine comprises an X-axis driving mechanism and a Y-axis driving mechanism both having an X-axis drive motor and a Y-axis drive motor both driven based on sewing data respectively. The carriage is moved in the front-rear direction by the Y-axis driving mechanism in the right-left direction by the X-axis driving mechanism.

For example, JP-2004-254987 discloses a multineedle embroidery sewing machine comprising a pair of mountings, a sewing pillar, a sewing arm, a cylinder bed and a carriage movable in the front-rear direction. An embroidery frame movable in the right-left direction is attached to the carriage. A desired embroidery pattern is formed on workpiece cloth held on the embroidery frame based on the sewing data stored on a read only memory (ROM) incorporated in a control device.

On the other hand, a quilting stitch has recently been desired with the use of quilting cloth having a three-layer structure in which cotton, plume or urethane foam is stuffed between top fabric and underlining. Stitches are formed on the top fabric so as to form a decorative pattern. In this case, while a needlebar of the embroidery sewing machine is driven up and down, the operator manually moves the three-layered quilting cloth in any direction to combine straight stitches and curved stitches, thereby forming the quilting stitch in a joyful way.

The aforesaid conventional multineedle embroidery sewing machine is directed to forming an embroidery pattern of some sort on workpiece cloth held on the embroidery frame. Accordingly, when using the embroidery sewing machine, the operator needs to select a desired embroidery pattern previously before operation of the start switch. Furthermore, when using the aforesaid embroidery sewing machine to carry out the quilting stitches, the operator detaches the embroidery frame from the carriage, selects a suitable embroidery frame and then operates the start switch. The control device then drives the sewing machine motor so that the needlebar is vertically moved. Thus, the quilting stitch is considered to be carried out by manually moving the quilting cloth suitably by the operator. However, since the carriage is moved upon drive of the needlebar, the carriage stands in the way when the operator moves the quilting cloth, whereupon the quilting stitch cannot substantially be carried out.

SUMMARY

Therefore, an object of the present disclosure is to provide an embroidery sewing machine can carry out the quilting stitch without being interrupted by the carriage as well as form an embroidery pattern by the use of an embroidery frame.

The present disclosure provides an embroidery sewing machine comprising an embroidery frame holding workpiece cloth to be sewn, a carriage transferring the embroidery frame detachably attached thereto, a drive unit which moves the carriage, a sewing machine motor, a control unit which controls the drive unit and the sewing machine motor so that an embroidery sewing mode is executed in which an embroidery pattern is sewn or a manual-feed sewing mode is executed in which a sewing operation is carried out with manual cloth feed while the carriage is moved to and held at a predetermined evacuative position, a foot controller, a connecting part connecting the foot controller to the control unit so that the foot controller is detachable from the connecting part, and a mode switching unit which selectively switches between the embroidery sewing mode and the manual feed sewing mode, wherein the mode switching unit switches to the embroidery sewing mode when the foot controller is non-connected to the connecting part, and to the manual feed sewing mode when the foot controller is connected to the connecting part.

According to the above-described construction, on one hand, the selected embroidery pattern becomes sewable when the operator switches the mode changing unit to the embroidery sewing mode. On the other hand, when the operator switches the mode changing unit to the manual feed sewing mode, the carriage is moved to the predetermined evacuation position. Moreover, the carriage is held at the evacuation position so as to be stationary. Consequently, the operator can carry out the quilting stitch without being interrupted by the carriage while manually moving the quilting cloth in any direction using a sufficient working space.

The disclosure also provides an embroidery sewing machine comprising an embroidery frame holding workpiece cloth to be sewn, a carriage transferring the embroidery frame detachably attached thereto, a drive unit which moves the carriage, a sewing machine motor, a pattern data storing unit which stores data of a plurality of embroidery patterns, the data of a plurality of embroidery patterns including evacuating drive data for moving the carriage to a predetermined evacuation position and holding drive data for holding the carriage at the evacuation position or a position near the evacuation position, and a control unit which controls the drive unit and the sewing machine motor.

According to the above-described construction, in one hand, when any desired one of a plurality of embroidery patterns is selected by the control unit, the driving unit and the sewing machine motor are controlled based on the embroidery pattern data of the selected embroidery pattern. As a result, embroidery sewing is carried out on the workpiece cloth on the embroidery frame attached to the carriage. On the other hand, when the carriage is to be held at the evacuation position or the position near the evacuation position for the quilting stitch but not of an embroidery pattern, the driving unit and the sewing machine motor are controlled based on the evacuating drive data and the holding drive data by the control unit. In this case, the carriage is held at the evacuation position or the position near the evacuation position. Consequently, when selecting specific evacuating drive data stored on the pattern data storage unit and holding drive data, the operator can carry out the quilting stitch without being interrupted by the carriage while manually moving the quilting cloth in any direction using a sufficient working space.

BRIEF DESCRIPTION OF THE DRAWINGS

Other objects, features and advantages of the present disclosure will become clear upon reviewing the following description of the embodiment with reference to the accompanying drawings, in which.

DETAILED DESCRIPTION OF THE DISCLOSURE

Figure 1:
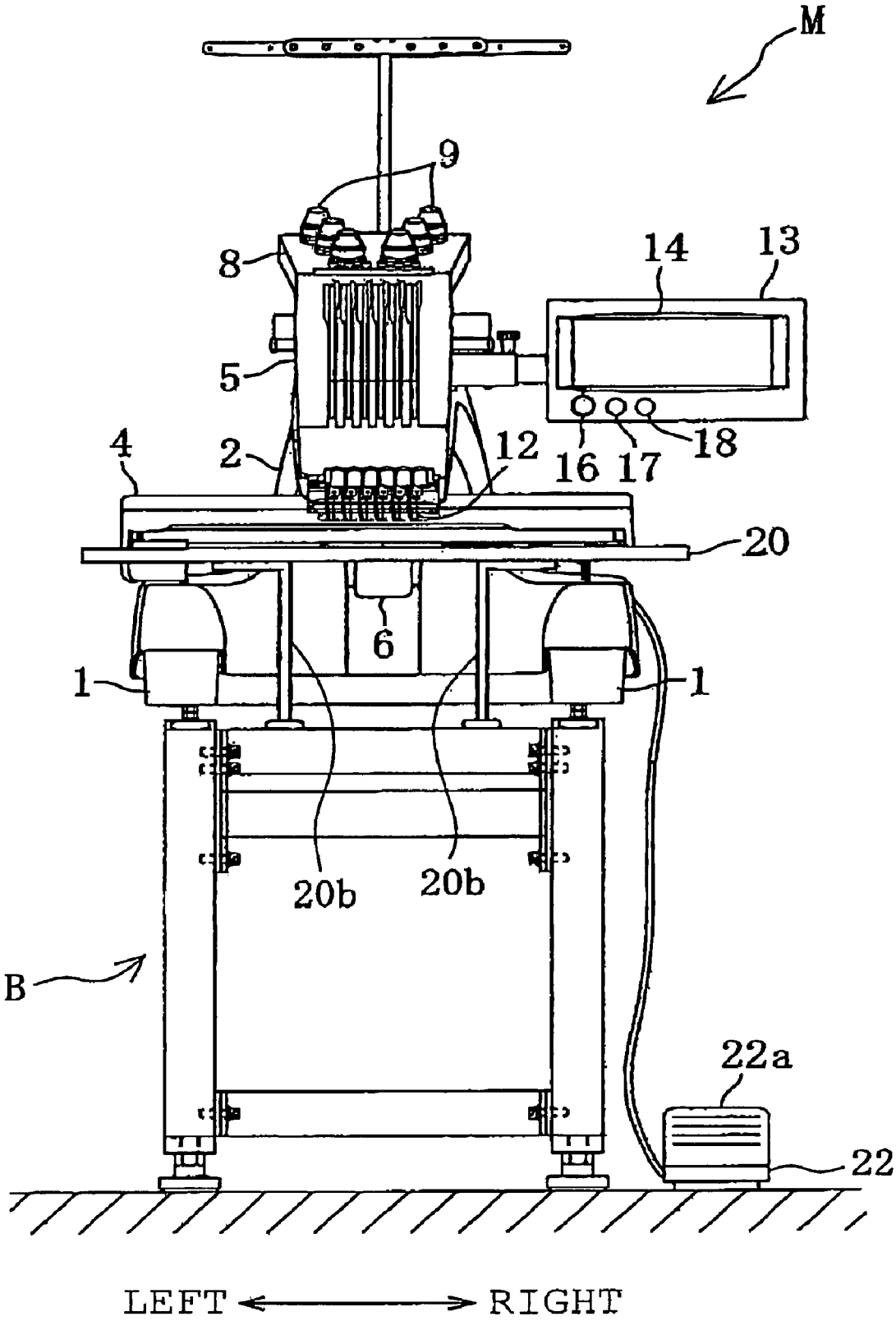
FIG. 1 is a front view of a multineedle embroidery sewing machine in accordance with a first illustrative example of the present disclosure.
Figure 2:
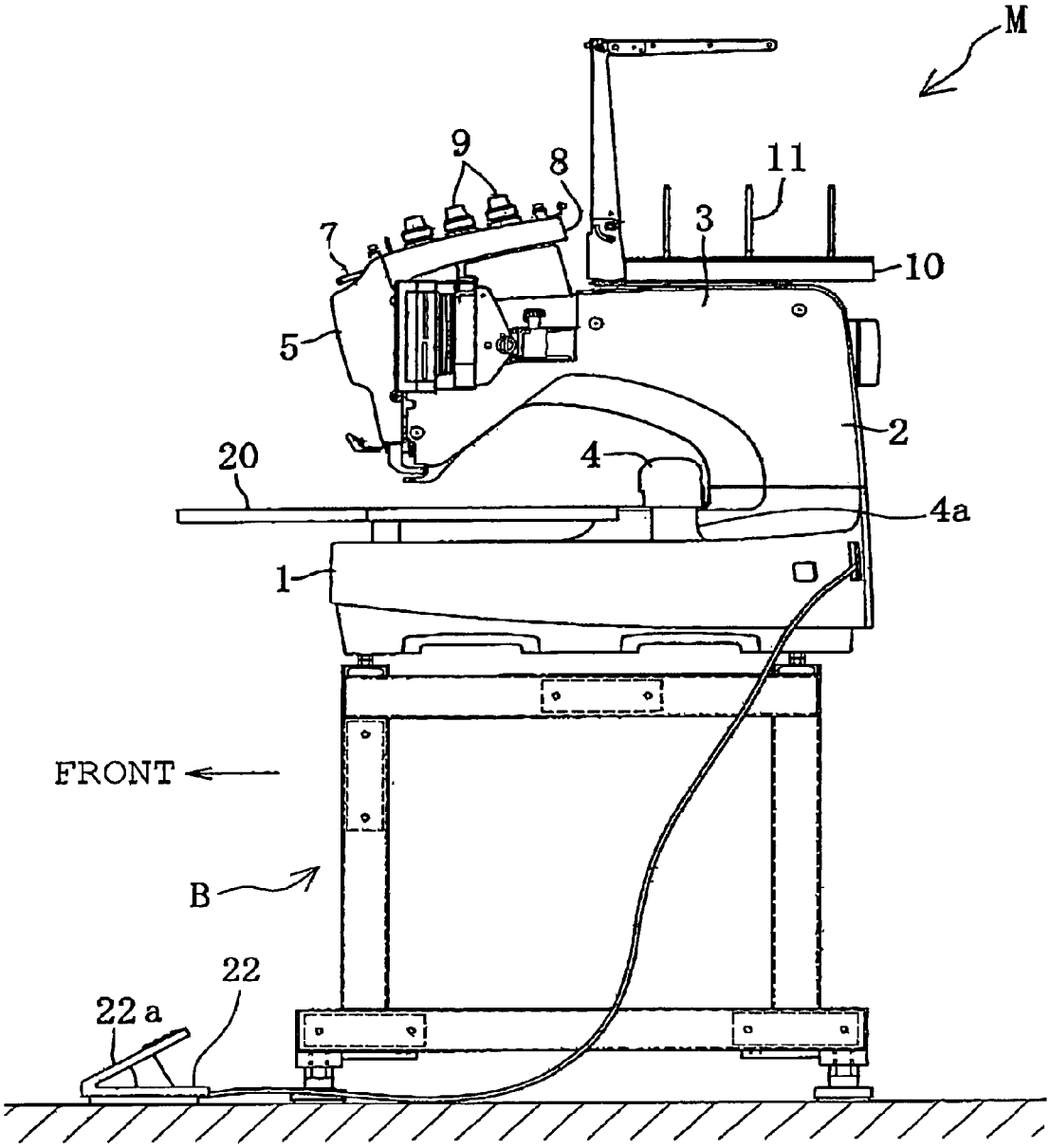
FIG. 2 is a right side view of the multineedle embroidery sewing machine.

A first illustrative example of the disclosure will be described with reference to FIGS. 1 to 8. The disclosure is applied to a multineedle embroidery sewing machine M in the example. Referring to FIGS. 1 and 2, the multineedle embroidery sewing machine M includes a pair of legs 1, a sewing pillar 2 standing at rear ends of the legs 1 and a sewing arm 3 protruding frontward from the top of the pillar 2. The multineedle embroidery sewing machine M is mounted on a mounting stand B installed on the floor.

The legs 1 have a pair of guide grooves 1*a* (see FIG. 3) which are formed in upper surfaces so as to extend in the front-rear direction, respectively. A carriage 4, which is elongate in the front-rear direction, has right and left ends provided with a pair of leg members 4*a* (only one is shown in FIG. 2) respectively. The leg members 4*a* are inserted through the guide grooves 1*a* from above so as to be guided along the guide grooves 1*a* in the front-rear direction respectively.

A frame mounting (not shown) is provided on the front of the carriage 4. An embroidery frame (not shown) is mounted on the frame mounting to hold workpiece cloth to be sewn. In the carriage 4 is provided a right-left driving mechanism (not shown) having an X-axis drive motor 37 (see FIG. 5). Upon drive of the X-axis drive motor 37, the frame mounting is driven in the right-left direction by the right-left driving mechanism. The legs 1 are provided with a front-rear driving mechanism (not shown) having a Y-axis drive motor 39 (see FIG. 5). Upon drive of the Y-axis drive motor 39, the carriage 4 is driven via the leg members 4*a* in the front-rear direction by the front-rear driving mechanism. Thus, the embroidery frame is moved in the front-rear direction in synchronization with the carriage 4 and further moved in the right-left direction together with the frame mounting, thereby feeding the workpiece cloth.

A needlebar case 5 is attached to the front of the arm 3. A cylinder bed 6 is mounted on the pillar 2 so as to protrude forward. Six sewing needles (not shown) are attached to the needlebar case 5. Each needlebar has a lower end to which a sewing needle 12 is attached. Six needle thread take-ups 7 are attached to the needlebar case 5 so as to correspond to the needlebars respectively. The needlebar case 5 has an upper end to which a thread tension guide 8 is fixed. The thread tension guide 8 is made from a synthetic resin and slightly inclined rearwardly upward. Six thread tension regulators 9 are mounted on the thread tension guide 8 for needle threads supplied to the sewing needles 12 respectively.

A spool holder base 10 is mounted on the top of the arm 3. Six spool pins 11 stand on the spool holder base 10. Six thread spools can be attached to the spool pins 11 respectively. Needle threads extending from the thread spools mounted on the spool pins 11 are threaded through the corresponding thread tension regulators 9 and the needle thread take-ups 7 and thereafter supplied to the needles 12 mounted on lower ends of the needlebars respectively. A needlebar selecting mechanism corresponding to a needlebar selecting unit and not shown is provided in the arm 3. The needlebar selecting mechanism is driven by a needlebar changing motor 33 (see FIG. 5). The needlebar case 5 is moved in the right-left direction together with the thread tension guide 8 by the needlebar selecting mechanism so that one of the six needlebars and one of the six needle thread take-ups 7 are selected and caused to assume respective drive positions.

Upon drive of the sewing machine motor 31 (see FIG. 5), the needlebar and the needle thread take-up 7 assuming the respective drive positions are driven vertically in synchronization with each other. In cooperation with a rotary hook provided on a front end of the cylinder bed 6, the needlebar and the needle thread take-up 7 form embroidery stitches on the workpiece cloth held by the embroidery frame over the cylinder bed 6. Furthermore, an operation panel 13 of the touch panel type is provided on the right side of the arm 3 and is foldable. The operation panel 13 serves as an operation input unit.

Figure 4:
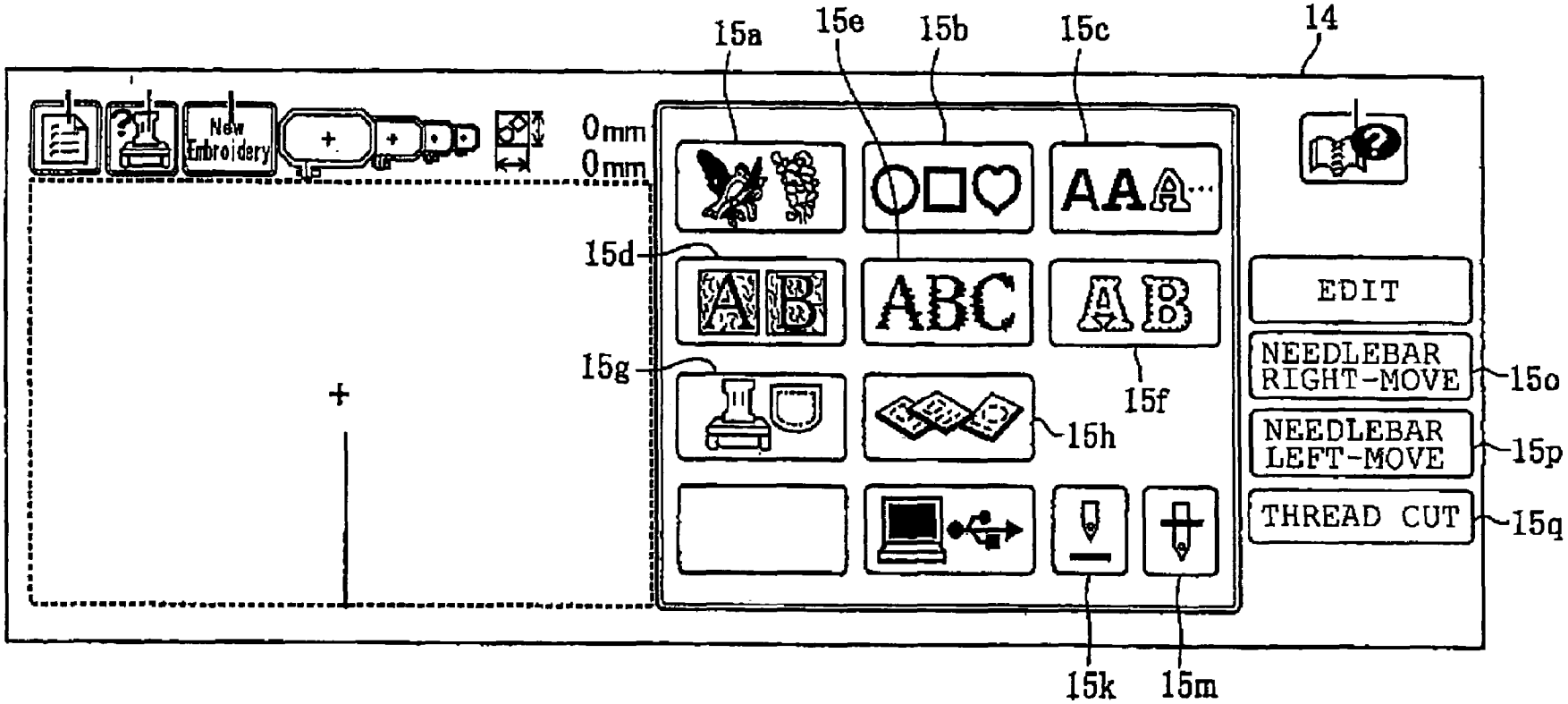
FIG. 4 is a front view of a screen of a liquid crystal display.

The operation panel 13 is provided with a large liquid crystal display 14 which is long in the right-left direction as shown in FIG. 1. The operation panel 13 includes keys which input various commands to a control device 25 which will be described later. More specifically, a start/stop (S/S) key 16 is disposed below the liquid crystal display 14 of the operation panel 13. The S/S key 16 is operated so that start and stop of a sewing operation is instructed. A speedup key 17 and a slowdown key 18 are also disposed below the liquid crystal display 14 of the operation panel 13. Furthermore, a plurality of touch keys 15 are provided on the surface of the liquid crystal display 14 so as to correspond to a plurality of types of pattern group images and the like displayed on the display 14, respectively, as shown in FIG. 4. More specifically, the touch keys 15 include pattern group keys 15*a*, 15*b*, 15*c*, 15*d*, 15*e*, 15*f* 15*g* and 15*h*, a needle up-position stop key 15*k*, a needle down-position stop key 15*m*, a needlebar right-hand movement key 15*o*, a needlebar left-hand movement key 15*p* and a thread cut key 15*q*. Each touch key 15 is transparent.

Figure 3:
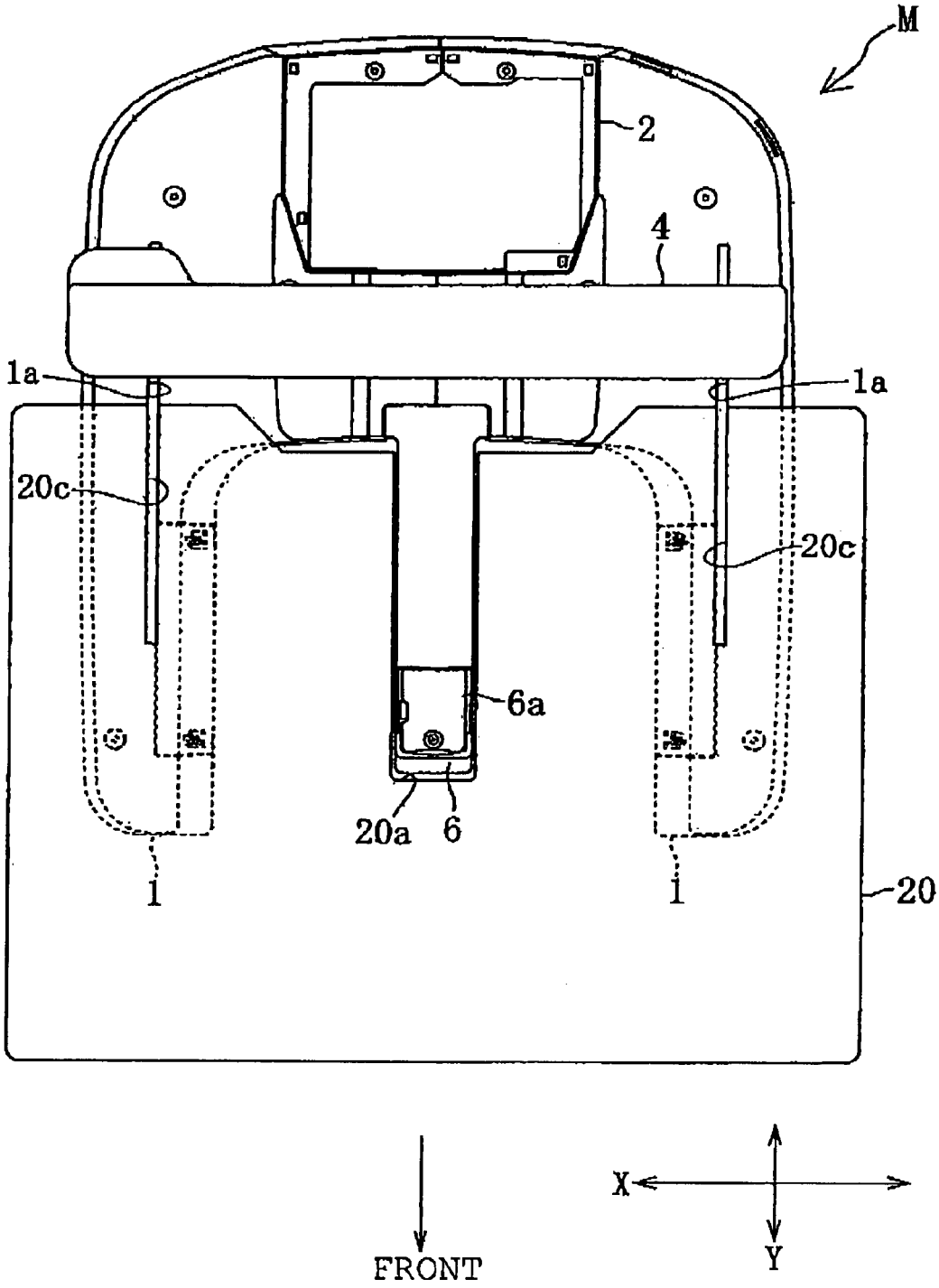
FIG. 3 is a partial cross-sectional view of the multineedle embroidery sewing machine.

A working table 20 is horizontally mounted on the legs 1 as shown in FIGS. 1 to 3. More specifically, the working table 20 is supported on a plurality of support legs 20*b* (see FIG. 1) further supported on the mounting stand B so that an upper surface of the working table 20 is coplanar with an upper side of the needle plate 6*a* mounted on the upper surface of the front end of the cylinder bed 6. The working table 20 has a slit 20*a* formed in the lengthwise and crosswise central portion thereof. The slit 20*a* is formed by cutting off the working table so as to have the same width as the cylinder bed 6. The working table 20 further has a pair of slits 20*c* which are formed therein so as to extend forward from the right and left rear ends of the working table 20 and so as to be opposed to the paired guide grooves 1*a*, respectively. Each slit 20*c* is formed by cutting out the working table 20 so as to have a slightly larger width than each leg 4*a* of the carriage 4.

A foot controller 22 serving as a mode switching unit is disposed on the floor on which the mounting stand B of the multineedle embroidery sewing machine M is also placed. A footplate 22 is pivotally mounted on the foot controller 22 and adapted to be pressed by the operator. The foot controller 22 is incorporated with a variable resistor (volume or slider) whose resistance value is varied according to an amount of pressing against the footplate 22*a*.

Figure 5:
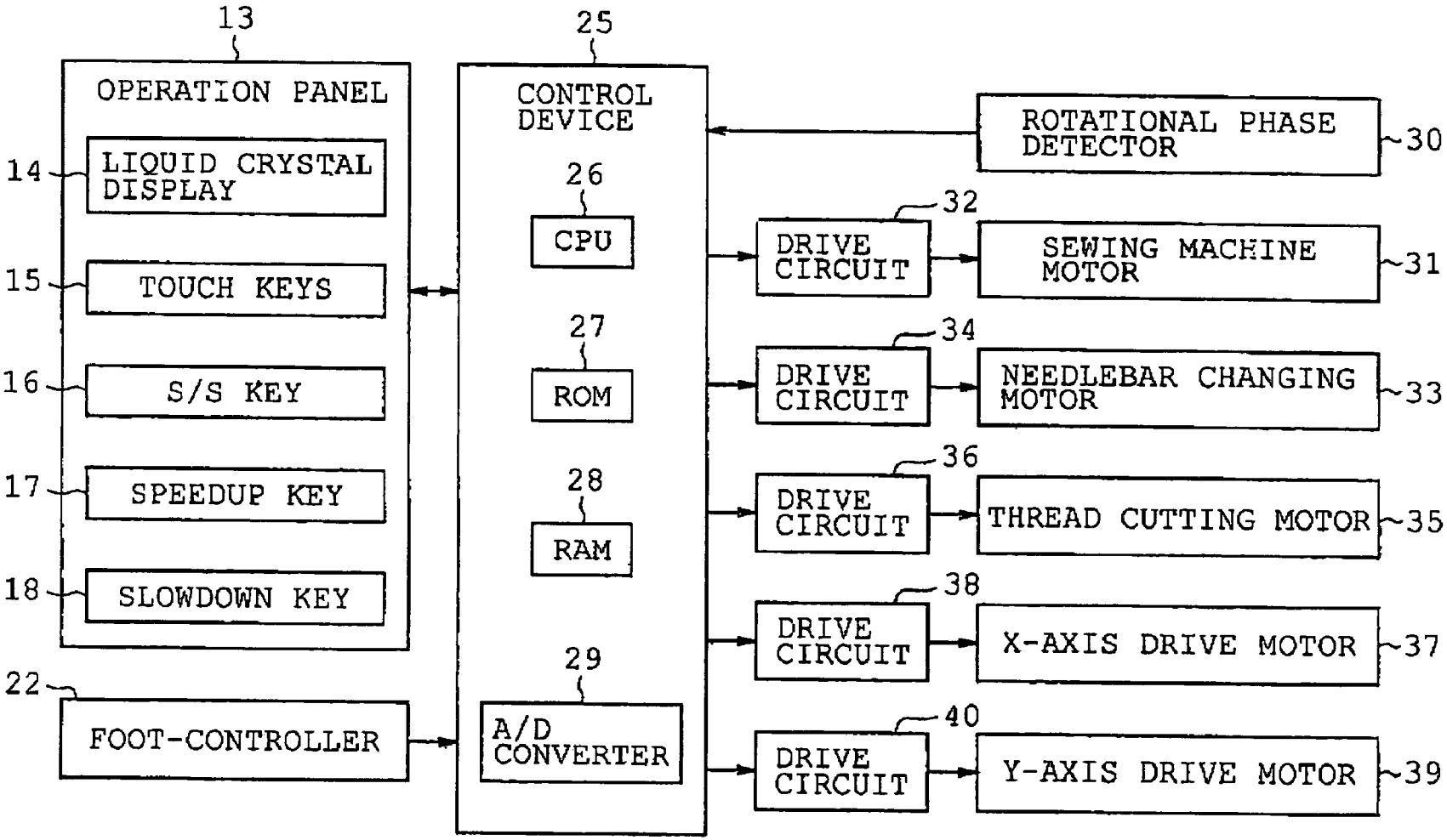
FIG. 5 is a block diagram showing the control system of the multineedle embroidery sewing machine.

The control system of the multineedle embroidery sewing machine M will now be described. Referring to FIG. 5, a control device 25 serving as a control unit comprises a microcomputer including a central processing unit (CPU) 26, a read only memory (ROM) 27, a random access memory (RAM) 28, an analog/digital (A/D) converter 29 and the like. The control device 25 further includes an input/output port, an input port, an output port and an analog input port although none of the ports are shown.

The operation panel 13 is connected to the input/output port of the control device 25. A rotational phase detector 30 is connected to the input port of the control device 25. To the output port of the control device 25 are connected a drive circuit 32 for the sewing machine motor 31, a drive circuit 34 for the needlebar changing motor 33, a drive circuit 36 for a thread cutting motor 35, a drive circuit 38 for an X-axis drive motor 37 and a drive circuit 40 for a Y-axis drive motor 39. The foot controller 22 is connected to the analog input port (serving as a connecting part) of the control device 25. Pressing voltage according to an amount of pressing the operator applies to the footplate 22*a* is delivered to the analog input port of the control device 25.

Figure 6:
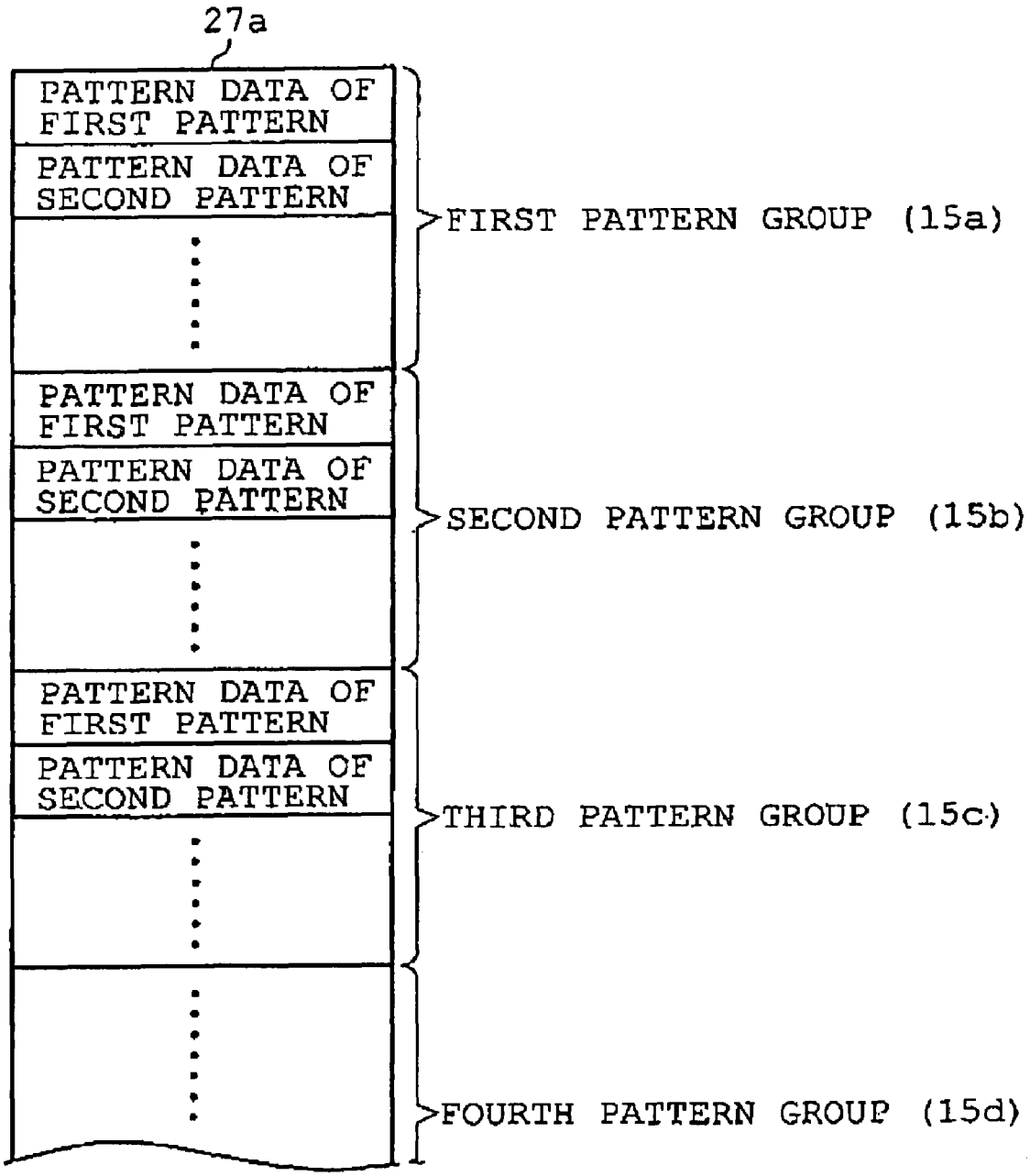
FIG. 6 illustrates data structure of a pattern data memory.

The ROM 27 stores a sewing control program which is peculiar to the illustrative example and is provided for control of the multineedle embroidery sewing machine M, a plurality of types of pattern data provided for execution of embroidery sewing and the like. For example, the ROM 27 includes a pattern data memory 27*a* storing a plurality of pattern data relating to a plurality of pattern groups classified for every pattern, respectively as shown in FIG. 6. More specifically, the pattern data memory 27*a* stores data of a first pattern group corresponding to the pattern group key 15*a*, data of a second pattern group corresponding to the pattern group key 15*b*, data of a third pattern group corresponding to the pattern group key 15*c*, data of a fourth pattern group corresponding to the pattern group key 15*d*, data of a fifth pattern group corresponding to the pattern group key 15*e*, data of a sixth pattern group corresponding to the pattern group key 15*f*, data of a seventh pattern group corresponding to the pattern group key 15*g* and data of an eighth pattern group corresponding to the pattern group key 15*h*, as shown in FIG. 4. Furthermore, although the embodiment exemplifies eight pattern group data, ninth or subsequent pattern groups may be stored, if necessary.

The first pattern group data is selected by the first pattern group key 15*a* and includes a plurality of embroidery patterns (a first pattern, a second pattern, a third pattern, . . . ) further contained in the first pattern group relating to spot patterns such as "bird,", "flower" and the like, for example. The second pattern group data is selected by the second pattern group key 15*b* and includes a plurality of embroidery patterns (a first pattern, a second pattern, a third pattern, . . . ) further contained in the second pattern group relating to spot patterns such as "circular frame," "square frame" and the like, for example. The third pattern group is selected by the third pattern group key 15*c* and includes a plurality of embroidery patterns (a first pattern, a second pattern, a third pattern, . . . ) further contained in the third pattern group relating to spot patterns such as first decorative characters of alphabet, for example. Each of the fourth to eighth pattern group data is composed in the same manner as the above-described first and second pattern group data. Accordingly, detailed description of the fourth to eighth pattern groups will be eliminated.

The RAM 28 is provided with a memory for storing embroidery data of an embroidery pattern to be sewn which has been read from the ROM 27. The RAM 28 is further provided with various buffers which temporarily store data of results of computing executed by the CPU 26. The pressing voltage which is delivered from the foot controller 22 and is indicative of an amount of pressing against the footplate 22*a* is converted to a corresponding digital signal by the A/D converter 29. However, when the foot controller 22 is connected to the control device 25, voltage (involving the pressing voltage) equal to or higher than a predetermined value is applied to the analog input port of the control device 25. When the foot controller 22 is disconnected from the control device 25, 0 V is applied to the analog input port.

Figure 7:
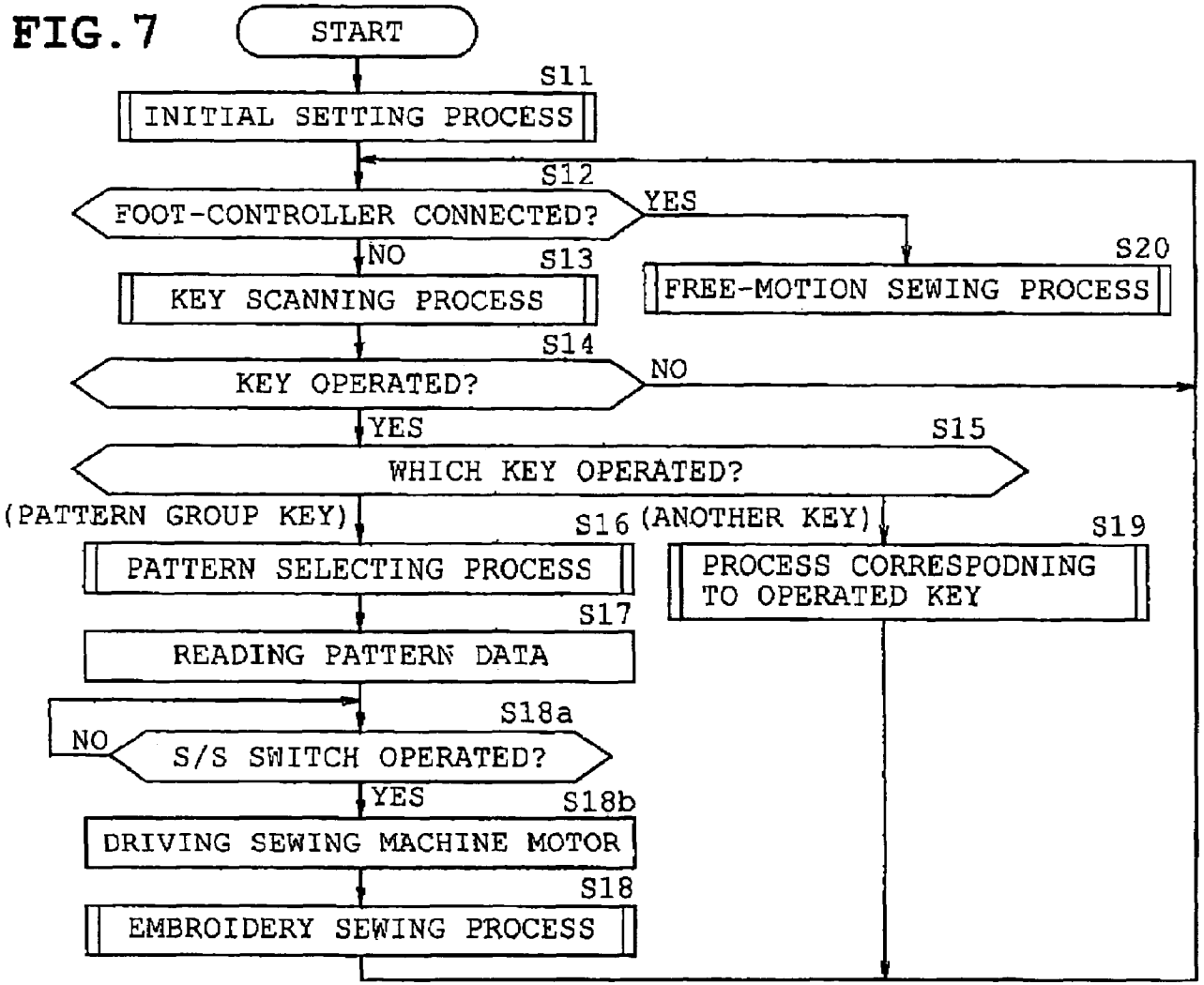
FIG. 7 is flowchart showing a sewing processing.
Figure 8:
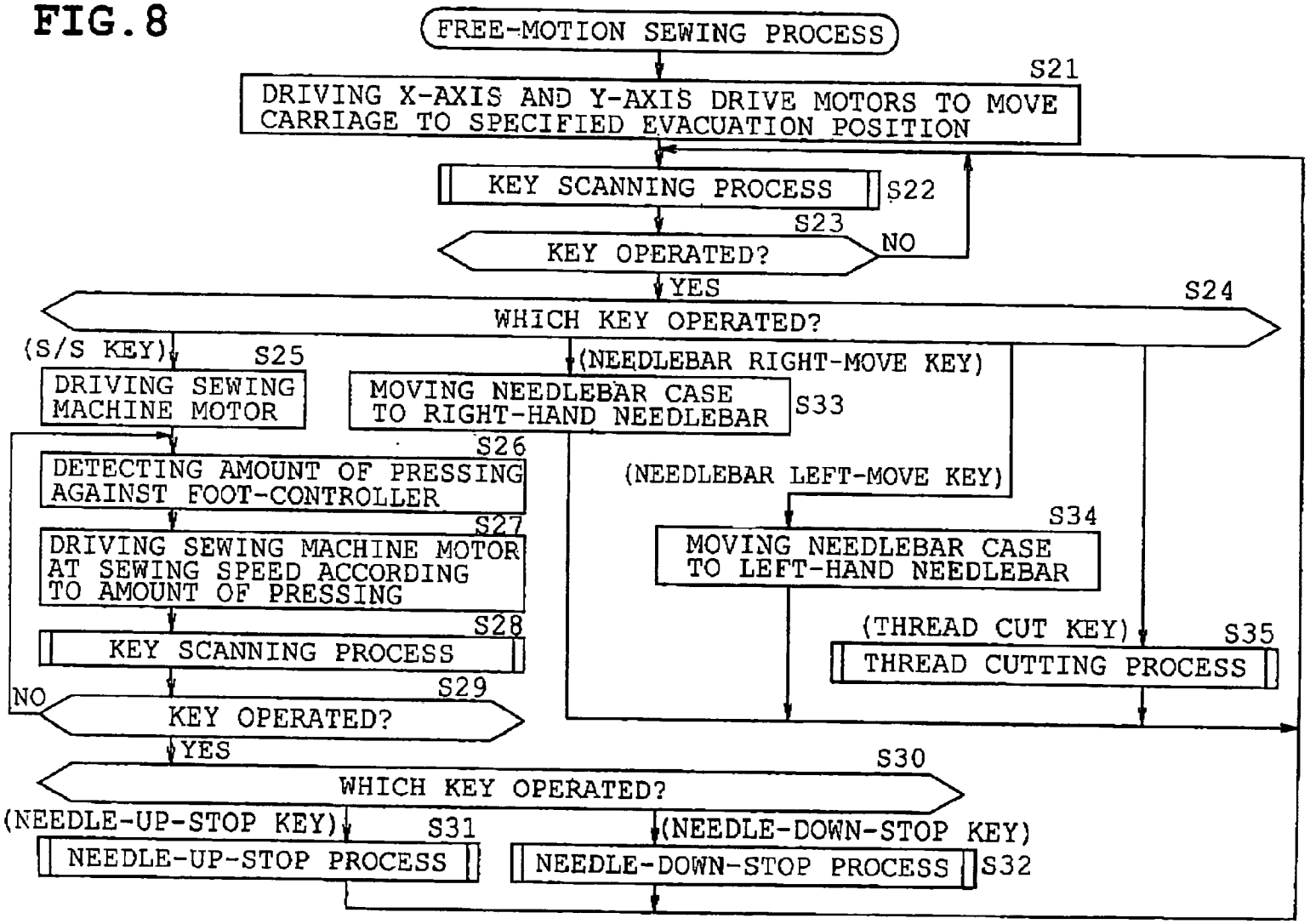
FIG. 8 is a flowchart showing free-motion sewing processing.

The sewing processing routine performed by the control device 25 of the sewing machine M will be described with reference to FIGS. 7 and 8. FIG. 7 is a flowchart showing the sewing processing. FIG. 8 is a flowchart showing free-motion sewing processing. In the figures, symbols Si (where i=11, 12, 13, . . . ), S18*a* and S18*b* designate steps. On one hand, when embroidery sewing is to be carried out, the workpiece cloth is held by the embroidery frame. The embroidery frame is attached via the frame mounting to the carriage 4. On the other hand, when a quilting stitch is to be carried out, quilting cloth is prepared on the working table 20 without use of the embroidery frame.

When electric power is supplied to the multineedle embroidery sewing machine M, the following processing as shown in FIG. 7 starts (START). The control device 25 firstly carries out initial setting (S11). In the initial setting, the control device 25 drives the X-axis and Y-axis drive motors 37 and 39 so that the carriage 4 is moved to the center of the working area or an origin. The control device 25 further clears the memories of the RAM 28. Subsequently, the control device 25 reads the voltage at the analog input port. When the result of read indicates that 0 V is applied to the analog input port or when the foot controller 22 is not connected to the foot controller 22 (S12: No), the control device 25 carries out a setting operation for an embroidery sewing mode. In the embroidery sewing mode, the control device 25 executes a key scanning process (S13), thereby detecting as to which of the touch keys 15*a*-15*h*, 15*k*, 15*m* and 15*o* to 15*q* has been operated.

When none of the keys 15*a*-15*h*, 15*k*, 15*m* and 15*o* to 15*q* have been operated (S14: No) as the result of execution of the key scanning process (S13), the control device 25 reads the voltage of the analog input port (S12). On the other hand, when any one of the embroidery group keys 15*a*-15*h* has been operated (S14: Yes; and S15), the control device 25 executes an embroidery pattern selecting process to select a desired pattern based on the key operation (S16). In the embroidery pattern selecting process, the control device 25 reads pattern data of the selected embroidery pattern from the ROM 27 and stores the read data on the RAM 28 (S17). When the operator operates the start/stop key 16 (S18*a*: Yes), the control device 25 drives the sewing machine motor 31 based on a sewing start command signal delivered thereto from the operation panel 13 (S18*b*) and further drives the X-axis and Y-axis motors 37 and 39 based on the pattern data. When the start/stop key 16 has not been operated (S18*a*: No), S18*a* is repeated.

When any one of the keys 15*a*-15*h*, 15*k*, 15*m* and 15*o* to 15*q* has been operated as the result of execution of the key scanning process (S13), processing corresponding to the operated key is carried out (S19). For example, when the thread cutting key 15*q* has been operated, the control device 25 de-energizes the sewing machine motor 31 and thereafter executes a thread cutting process. Furthermore, when the operated key is invalid in the control, the control device 25 executes a process in which a buzzer (not shown) or the like is activated to inform the operator of the invalidity of the operated key.

When the foot controller 22 is connected to the analog input port of the control device 25 (S12: Yes), a predetermined voltage is applied to the analog input port. When the predetermined voltage is applied to the analog input port, the control device 25 sets a free-motion mode (corresponding to a manual feed sewing mode) thereby to execute a free-motion sewing process (see FIG. 8; S20). Firstly, the control device 25 drives the X-axis and Y-axis drive motors 37 and 39 so that the carriage 4 is moved to a specified evacuation position (S21). In the free-motion sewing process, the carriage 4 is moved to, for example, a maximum evacuation position in a range of movement in the front-rear position thereby to assume the specified evacuation position. The carriage 4 is held in a stopped state at the evacuation position. More specifically, since the carriage 4 is evacuated to the evacuation position which is located in the rear of the working table 20, the operator can use the working table effectively without being interrupted by the carriage 4.

Subsequently, the control device 25 executes a key-scanning process (S22). When the operator has operated the needlebar right-move key 15*o* (S23: Yes; and S24), the needlebar switching motor 33 is driven to move the needlebar case 5 rightward (S33). Furthermore, when the operator has operated the needlebar left-move key 15*p* (S23: Yes; and S24), the needlebar switching motor 33 is driven to move the needlebar case 5 to a left-hand needlebar (S34). When the operated key is invalid in the control as the result of execution of the key-scanning process, the control device 25 executes a process in which a buzzer (not shown) or the like is activated to inform the operator of the invalidity of the operated key.

When the operator has operated the start/stop key 16 (S22 and S23: Yes; and S24), the control device 25 drives the sewing machine motor 31 based on the sewing start command signal supplied from the operation panel 13 (S25). Subsequently, the control device 25 detects an amount of pressing against the foot controller 22 based on the pressing voltage applied to the analog input port (S26) and controls the sewing machine motor 31 based on a speed command signal according to an amount of pressing received from the foot controller 22 (S27). The control device 25 re-executes the key scanning process (S28). When none of the keys 15*a*-15*h*, 15*k*, 15*m* and 15*o* to 15*q* have been operated (S29: No), the control device 25 executes S26 to S29 repeatedly. More specifically, since the sewing machine motor 31 is driven at desirable sewing speeds so that the needlebar is driven vertically, the operator can carry out quilting stitches while manually moving the quilting cloth desirably on the working table.

When the operator has operated the needle-down-stop key 15*m* for the purpose of changing the direction of the quilting cloth during the quilting stitch, for example (S29: Yes; and S30), the control device 25 raises the needle 12 to an uppermost location. The control device 25 then carries out a needle-down-stop process in which the sewing machine motor is de-energized under the condition where the needle 12 assumes a lowermost location (S32), thereafter returning to S22. When the operator then operates the start/stop key 16, the control device 25 continues to execute the quilting stitch. On the other hand, when the operator has operated the needle-up-stop key 15*k* on the completion of the quilting stitch (S29: Yes; and S30), the control device 25 causes the needle 12 to rise to the uppermost location. The control device 25 executes a needle-up-stop process in which the sewing machine motor 31 is de-energized while the needle 12 is located at the uppermost location (S31), thereafter returning to S22. When the operator has operated the thread cut key 15*q* (S23; Yes; and S24), the control device 25 executes a thread cutting process while the needle 12 is stopped at the uppermost location (S35).

The free motion mode as shown in FIG. 8 is terminated when the operator has powered off the sewing machine M. When the operator subsequently re-applies power to the sewing machine M, the control device 25 starts the sewing process as shown in FIG. 7. When the foot controller 22 is not connected to the control device 25, S13 and subsequent steps are carried out as described above. The control device 25 carrying out S12 in the sewing process serves as a mode switching unit.

Thus, the control device 25 of the multineedle embroidery sewing machine carries out both embroidery mode and free motion mode. Under the embroidery mode, the sewing machine M can sew an embroidery pattern using an embroidery frame. Under the free motion mode, the sewing machine M moves the carriage to the predetermined evacuation position and holds the carriage stopped at the evacuation position. In this condition, the workpiece cloth is manually fed so that sewing is carried out. Furthermore, the control device 25 can switch the sewing machine M between the embroidery mode and the free motion mode. Consequently, on one hand, when the operator selects the embroidery mode, the embroidery sewing can be carried out on the workpiece cloth held on the embroidery frame. On the other hand, when the operator switches the sewing machine M to the free motion mode, the carriage 4 is held stopped at the predetermined evacuation position. Accordingly, the carriage 4 is not driven at the evacuation position although the needlebar is vertically moved. Consequently, the operator can carry out a quilting stitch while manually feeding the workpiece cloth in any direction utilizing a sufficient working space without being interrupted by the carriage 4.

The foregoing multineedle embroidery sewing machine M comprises the foot controller 22 and the analog input port (connecting part) to which the foot controller 22 is detachably connected. The control device 25 switches the sewing machine M to the embroidery mode when the foot controller 22 is not connected to the analog input port. The control device 25 further switches the sewing machine M to the free motion mode when the foot controller 22 is connected to the analog input port. Consequently, the sewing machine M can be switched to the free motion mode just when the foot controller 22 is connected to the analog input port. Furthermore, the sewing machine M can be switched to the embroidery mode just when the foot controller 22 is detached from the analog input port.

The control device 25 controls the sewing machine motor 31 based on the sewing start command signal supplied thereto from the start/stop on the operation panel (operation input unit) 13. Consequently, the control device 25 can drive the sewing machine motor 31 so that sewing is started. Furthermore, the control device 25 controls the sewing machine motor 31 irrespective of the height position of the needlebar. More specifically, the sewing machine motor 31 is driven based on the sewing start command signal delivered from the start/stop key 16 on the operation panel 13 when the start/stop key 16 is operated even in the case where the needlebar is not located at the uppermost position. Consequently, the operator can start sewing irrespective of the height position of the needlebar.

The control device 25 controls the sewing machine motor 31 based on the speed command signal delivered thereto from the foot controller 22. Consequently, just when an amount of pressing against the foot controller 22 is adjusted, the sewing machine motor 31 can be driven so that sewing is started. Furthermore, the sewing speed can be adjusted according to an amount of pressing against the foot controller 22. Additionally, the multineedle embroidery sewing machine M comprises a plurality of needlebars and the needlebar selecting mechanism which selects any one of the needlebars. Accordingly, even when the sewing machine M is switched to the free motion mode so that a quilting stitch is executed, the control device 25 drives the needlebar changing motor 33 and further the needlebar selecting mechanism with drive of the motor 33. Consequently, the operator can select any one of the needlebars and accordingly change the needle thread arbitrarily.

FIGS. 9 to 12 illustrate a second example of the disclosure. The differences of the second example from the first example will be described. The construction of the multineedle embroidery sewing machine M and the arrangement of the control device 25 are substantially the same as those in the first example. Accordingly, detailed description of the sewing machine M and the control device will be eliminated.

Figure 9:
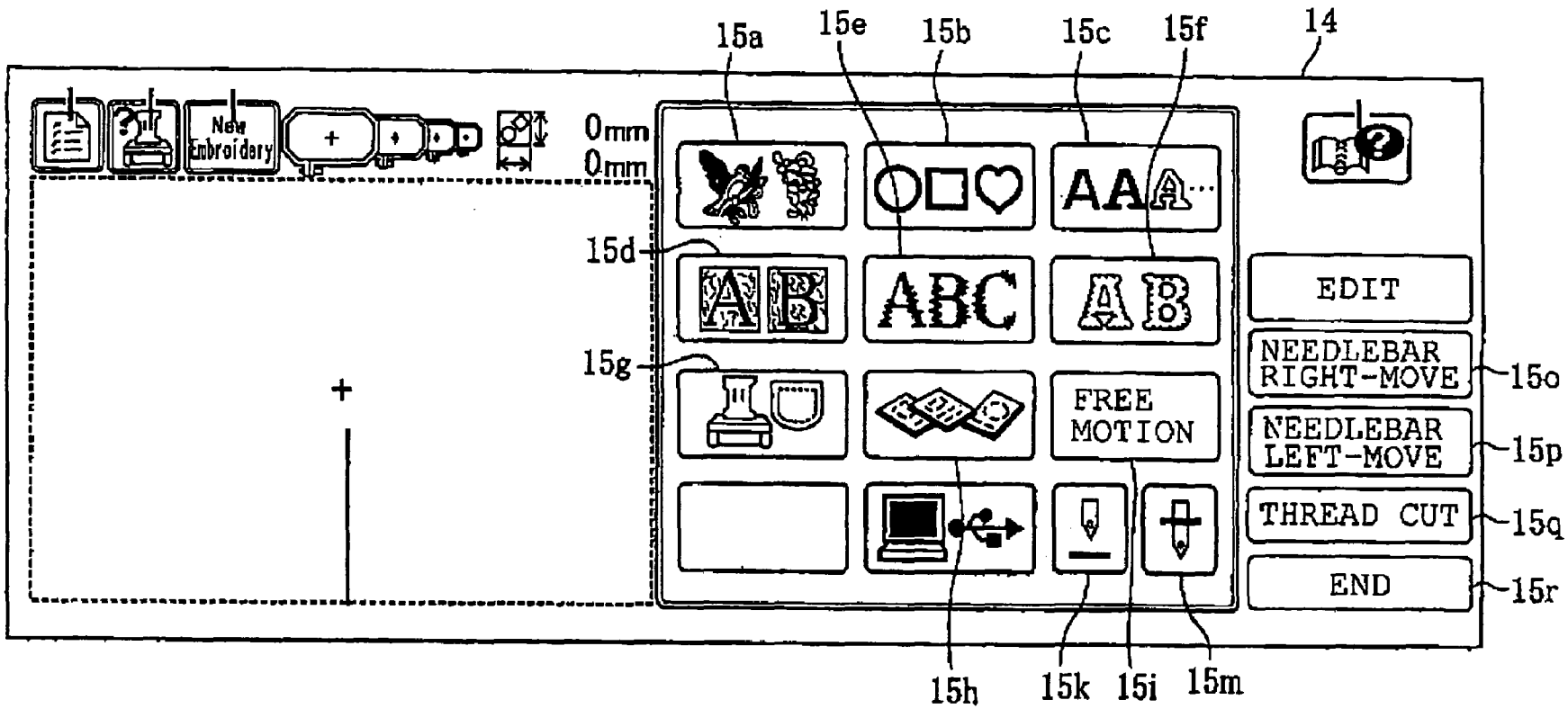
FIG. 9 is a view similar to FIG. 4, showing a second illustrative example of the present disclosure.
Figure 10:
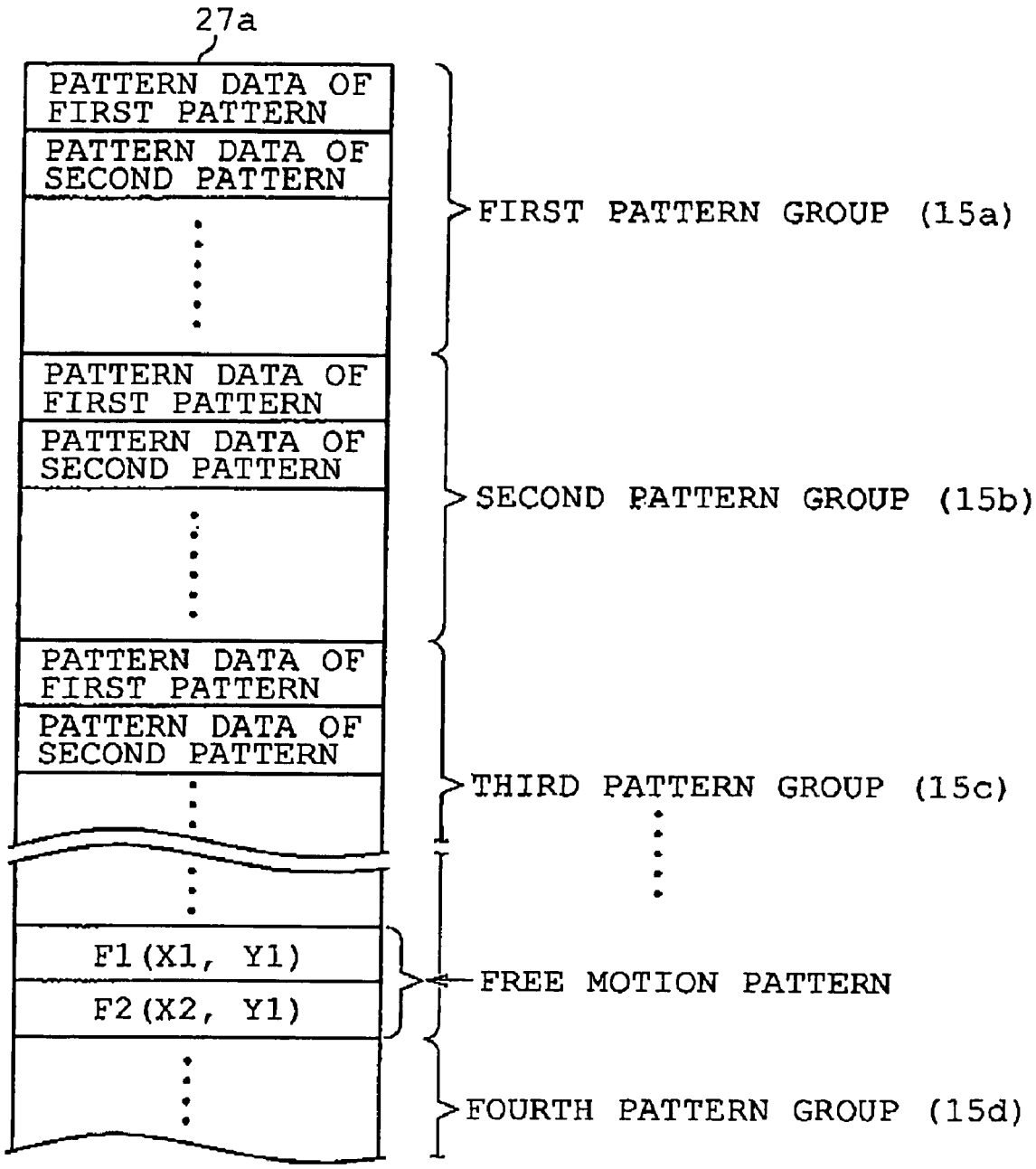
FIG. 10 is a view similar to FIG. 6, showing the second example.

The foot controller 22 is not connected to the control device 25 in the second example. Instead, a free-motion key 15*i* is added as a touch key to the operation panel 13, as shown in FIG. 9. The free-motion key 15*i* serves as a mode switching key. Furthermore, the pattern data memory 27*a* stores additional pattern data of free motion patterns (F1, F2) as a third pattern group as shown in FIG. 10. The pattern data memory 27*a* storing the pattern data of free motion patterns serves as a pattern data storing unit.

The pattern data of free motion patterns is provided for executing a quilting stitch (or patchwork) in a free motion mode. In other words, the pattern data of free motion patterns is a substitute for the pattern data of embroidery pattern or data of free motion patterns with manual operation of cloth feed or dummy data that is not actually used to form pattern stitches. The aforesaid data of free motion patterns is more specifically coordinate data (X1, Y1) of a first needle location F1 and coordinate data (X2, Y1) of a second needle location F2. The coordinate data of the first needle location F1 is indicative of an evacuation location where the carriage 4 is brought closest to the pillar 2. The coordinate data of the second needle location F2 is indicative of a location spaced from the first needle location F1 by a slight distance (0.1 mm, for example) in the X direction. The coordinate data of first needle location F1 serves as evacuation drive data. The coordinate data of second needle location F2 serves as hold drive data.

Figure 11:
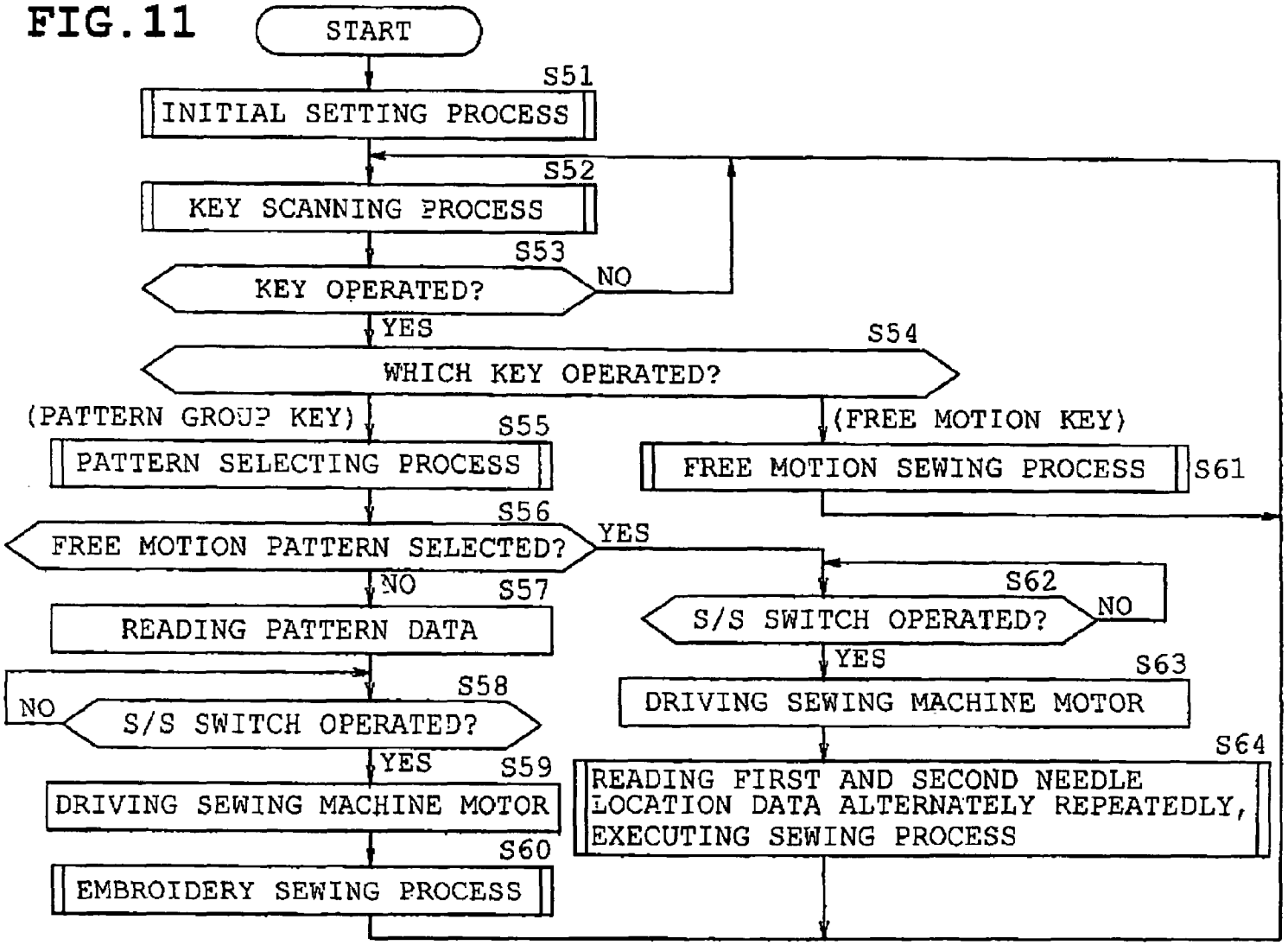
FIG. 11 is a view similar to FIG. 7, showing the second example.
Figure 12:
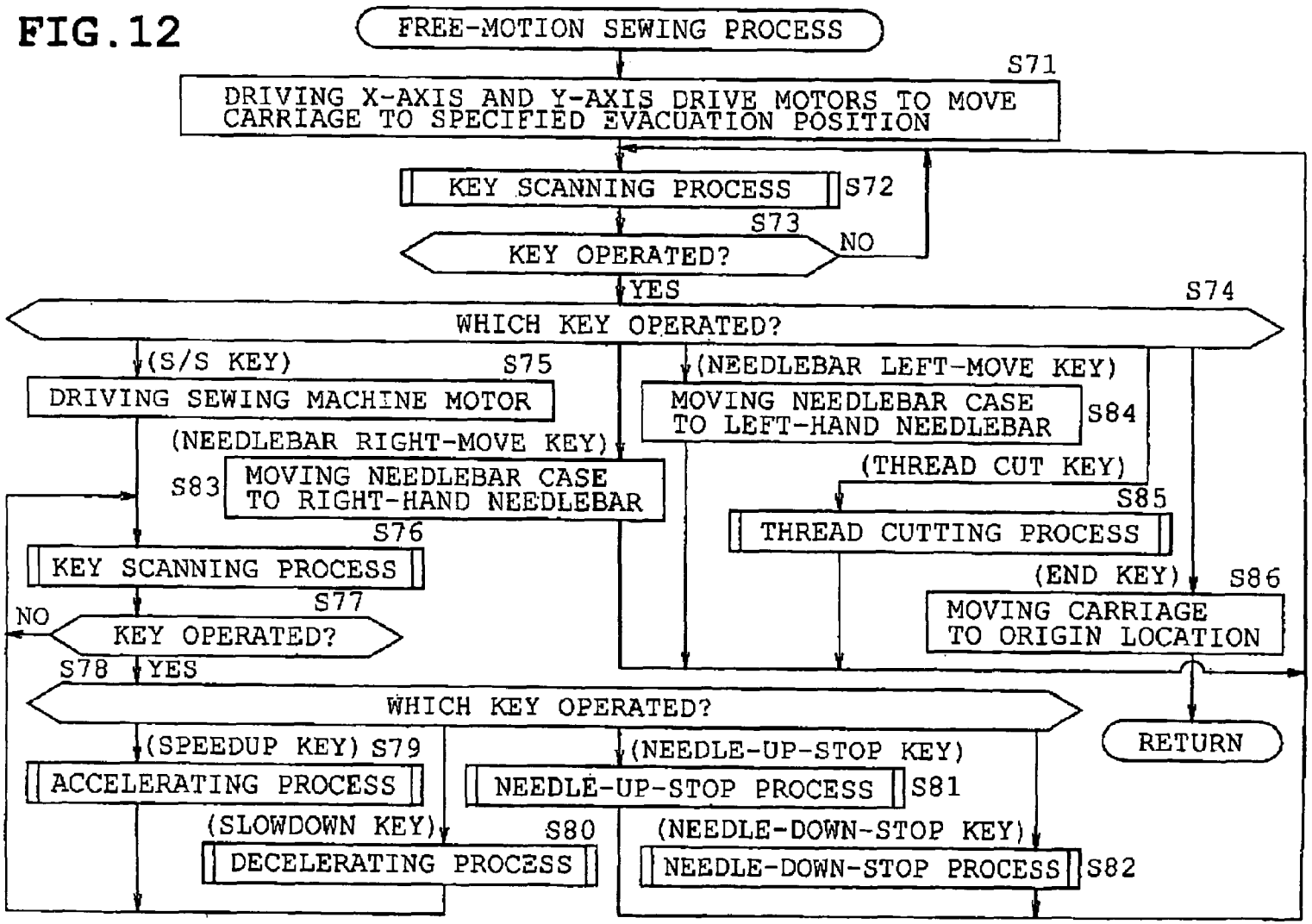
FIG. 12 is a view similar to FIG. 8, showing the second example.

The sewing process in the second example will be described with reference to the flowchart of FIG. 11. In the second example, too, when embroidery sewing is to be carried out, the workpiece cloth is held on an embroidery frame, which is attached to the carriage 4. When a quilting stitch is to be carried out, the embroidery frame is not used and quilting cloth is prepared on the working table 20.

When power is supplied to the multineedle embroidery sewing machine M, the control device 25 firstly executes an initial setting process (S51) in the same manner as at S11. Subsequently, the control device 25 executes a key scanning process (S52). When an operated key (S23) is invalid in the current control (S54), the control device 25 executes a process in which a buzzer or the like is activated to inform the operator of the invalidity of the operated key. When any one of the pattern group keys 15*a* to 15*h* has been operated (S53: Yes; and S54), the control device 25 executes an embroidery pattern selecting process to select a desired pattern based on the key operation (S55). The control device 25 executing S54 in the sewing process serves as the mode switching unit.

When an ordinary embroidery pattern has been selected other than the free motion embroidery pattern the data of which is stored in a third pattern group (S56; No) in the embroidery selecting process, the control device 25 reads the data of selected embroidery pattern from the pattern data memory 27*a* of the ROM 27. The read data is stored on the RAM 28 (S57). When the operator operates the start/stop key 16 (S58: Yes), the control device 25 drives the sewing machine motor 31 based on the sewing start command signal delivered from the start/stop key 16 on the operation panel 13 (S59) and executes an embroidery sewing process based on the pattern data (S60).

When the operator selects a free motion pattern (S56: Yes) and operates the start/stop key 16 in the pattern selecting process (S62: Yes), the control device 25 drives the sewing machine motor 31 based on the sewing start command signal supplied thereto from the start/stop key 16 on the operation panel 13 (S63). In this case, the control device 25 reads the free motion pattern data (F1, F2) stored on the pattern data memory 27*a*, storing the read data on the RAM 28. The control device 25 reads the pattern data (F1, F2) from the RAM 28 alternately repeatedly, executing the sewing process by the free motion (S64). However, when the operator operates the start/stop key 16 in S64, the sewing process is adapted to be terminated. More specifically, in the sewing process using the free motion pattern, the sewing needle is caused to drop onto the first needle location and the second needle location close to the first needle location alternately repeatedly. Accordingly, the control device 25 moves the frame mount in the X direction (right-left direction) by a slight distance while the carriage 4 is evacuated to the pillar 2 side. Thus, the control device 25 carries out a quilting stitch independently of pattern stitches. Consequently, the quilting stitch can be carried out for any period of time without being interrupted by the carriage 4 until the start/stop key 16 is operated.

When the free motion key has been operated (S53: Yes; and S54) as the result of key scanning process, the control device 25 sets the sewing machine M at the free motion mode, executing a free motion sewing process (see FIG. 12; and S61). Firstly, the control device 25 drives the X-axis and Y-axis drive motors 37 and 39 so that the carriage 4 is moved to the specified evacuation location (S71).

Subsequently, the control device 25 carries out the key scanning process (S72). When the needlebar right-move key 15*o* has been operated (S73: Yes; and S74), the control device 25 drives the needlebar changing motor 33 so that the needlebar case 6 is moved rightward by one needlebar (S83). Furthermore, when the needlebar left-move key 15*p* has been operated (S73: Yes; and S74), the control device 25 drives the needlebar changing motor 33 so that the needlebar case 6 is moved leftward by one needlebar (S84). When the operated key (S73) is invalid in the control (S74), the control device 25 executes a process in which a buzzer (not shown) or the like is activated to inform the operator of the invalidity of the operated key.

When the operator has operated the start/stop key 16 (S72; S73: Yes; and S74), the control device 25 drives the sewing machine motor 33 based on the sewing start command signal (S75). Subsequently, when re-executing the key scanning process (S76) and the acceleration key 17 has been operated (S77: Yes; and S78), the control device 25 executes an accelerating process in which the sewing speed is increased by a predetermined speed (S79). On the other hand, when the deceleration key 18 has been operated (S77: Yes; and S78), the control device 25 executes a decelerating process in which the sewing speed is reduced by a predetermined speed (S80). Furthermore, when none of the touch keys are operated (S77: No), the control device 25 executes S76 to S77 repeatedly. More specifically, the control device 25 drives the sewing machine motor 33 at desired sewing speeds so that the needlebar is driven vertically. Accordingly, the operator carries out the quilting stitch while moving the quilting cloth on the working table freely.

When wishing to change the direction of the quilting cloth during the quilting stitch, the operator operates the needle-down-stop key 15*m* (S77: Yes). In this case, the control device 25 carries out a needle-down-stop process (S82) in which the sewing needle 12 is caused to drop to a lowermost location, thereafter returning to S72. When the operator then operates the start/stop key 16, the control device 25 continuously executes the quilting stitch. On the other hand, when the operator operates the needle-up-stop key on the end of the quilting stitch (S77: Yes; and S78), the control device 25 carries out a needle-up-stop process (S81) in which the sewing machine motor 31 is de-energized while the sewing needle 12 is raised to an uppermost location, thereafter returning to S72. Furthermore, when the operator operates the thread cut key 15*q* (S73: Yes; and S74), the control device 25 carries out a thread cutting process (S85). Additionally, when the operator operates the end key 15*r* to terminate the free motion mode (S73: Yes; and S74), the control device 25 moves the carriage 4 to the predetermined origin location (S86) and terminates the free motion mode, returning to S52 (see FIG. 11) of the sewing control.

According to the second example, the free motion key (the mode switching key) 15*i* is provided on the operation panel 13, instead of the foot controller 22 in the first example (see FIG. 9). Consequently, when the operator operates the free motion key, the sewing machine M is set to the free motion mode, so that the free motion stitches can be carried out in the same manner as in the first example. Furthermore, the pattern data memory 27*a* stores the coordinate data of the first needle location F1 for moving the carriage 4 to the predetermined evacuation location and the coordinate data of the second needle location F2 for holding the carriage 4 at the evacuation location or the location close to the evacuation location. Consequently, the operator can select the special evacuation drive data and the hold drive data both stored on the pattern data memory. In this case, since the carriage 4 is allowed to be moved to the evacuation location, the quilting stitch can be carried out while the operator utilizes sufficient work space without being interrupted by the carriage 4.

When receiving the command to designate the coordinate data of first needle location F1 and second needle location F2, the control device 25 moves the carriage 4 to the evacuation location based on the coordinate data of first needle location F2. The control device 25 further controls the X-axis and Y-axis drive motors 37 and 39 so that the carriage 4 is held at the location close to the evacuation location based on the coordinate data of second needle location F2. Accordingly, when the operator selects the special evacuation drive data and hold drive data both stored on the pattern data memory 27*a*, the carriage 4 is moved to and held at the evacuation location. Consequently, since the work space is reliably ensured without the operator being interrupted by the carriage 4, the quilting stitch can be carried out while the quilting cloth is manually moved in any direction.

Several modified forms of the foregoing examples will now be described. In the second example, the foot controller may be designed to be connectable to the multineedle embroidery sewing machine. The sewing machine M may be set to the free motion mode while the foot controller is under connection to the sewing machine M. In this case, when the operator presses the foot controller, the control device may be designed to drive the sewing machine motor so that the free motion sewing is started. Furthermore, an amount of pressing against the foot controller may have a correspondence to the sewing speed.

When the free motion mode has been set in each of the first and second examples, the Y-axis location of the carriage may be designated arbitrarily on the operation panel. The carriage may be utilized to serve as a guide in the case where the quilting cloth is moved in the right-left direction (X-direction).

In the foregoing second embodiment, the coordinate data of the first and second needle locations F1 and F2 may be the same coordinate data. More specifically, the second needle location F2 may be the same as the first needle location F1. Adversely, only the coordinate data of either first or second needle location may be read out.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An embroidery sewing machine comprising:

an embroidery frame holding workpiece cloth to be sewn;

a carriage transferring the embroidery frame detachably attached to the carriage;

a drive unit which moves the carriage;

a sewing machine motor;

a control unit which controls the drive unit and the sewing machine motor so that an embroidery sewing mode is executed in which an embroidery pattern is sewn or a manual-feed sewing mode is executed in which a sewing operation is carried out with manual cloth feed while the carriage is moved to and held at a predetermined evacuative position;

a foot controller;

a connecting part connecting the foot controller to the control unit so that the foot controller is detachable from the connecting part; and a mode switching unit which selectively switches between the embroidery sewing mode and the manual-feed sewing mode, wherein the mode switching unit switches to the embroidery sewing mode when the foot controller is non-connected to the connecting part and to the manual-feed sewing mode when the foot controller is connected to the connecting part.

2. The embroidery sewing machine according to claim 1, further comprising an input unit which is operative to input various commands to the control unit, wherein the mode switching unit has a mode switching key provided in the input unit.

3. The embroidery sewing machine according to claim 2, wherein the control unit controls the sewing machine motor based on a sewing start command signal supplied thereto from the operation input unit.

4. The embroidery sewing machine according to claim 1, wherein the foot controller is electrically connected to the control unit so as to deliver a speed command signal to the control unit, and the control unit controls the sewing machine motor based on the speed command signal delivered from the foot controller to the control unit.

5. The embroidery sewing machine according to claim 1, further comprising a needlebar, wherein the control unit controls the sewing machine motor irrespective of a height position of the needlebar.

6. The embroidery sewing machine according to claim 1, further comprising a plurality of needlebars and a needlebar selecting unit which selects any one of the needlebars.

7. An embroidery sewing machine comprising:

a sewing pillar;

an embroidery frame holding workpiece cloth to be sewn;

a carriage transferring the embroidery frame detachably attached to the carriage;

a drive unit which moves the carriage;

a sewing machine motor;

a pattern data storing unit which stores data of a plurality of embroidery patterns, the data of a plurality of embroidery patterns including evacuating drive data for moving the carriage to a predetermined evacuation position where the carriage is brought to a work space perimeter that is closer to the pillar than to a needle bar of the embroidery sewing machine and holding drive data for holding the carriage at the evacuation position or a position near the evacuation position;

a switching unit to switch the embroidery sewing machine from an embroidery sewing mode to a free motion sewing mode, wherein the carriage is brought to the predetermined evacuation position during the free motion sewing mode; and a control unit which controls the drive unit and the sewing machine motor.

8. The embroidery sewing machine according to claim 7, wherein when receiving a command which designates the evacuating drive data and the holding drive data, the control unit controls the drive unit based on the evacuating drive data so that the carriage is moved to the evacuating position and subsequently, based on the holding drive data so that the carriage is held at the evacuation position or the position near the evacuation position.

9. The embroidery sewing machine according to claim 7, further comprising an operation input unit which inputs various commands to the control unit, or a foot controller and a connecting part connecting the foot controller to the control unit so that the foot controller is detachable from the connecting part, wherein the control unit controls the sewing machine motor based on a sewing start command signal the control unit receives from the operation input unit, or a speed command signal the control unit receives from the foot controller.

10. The embroidery sewing machine according to claim 7, further comprising a needlebar, wherein the control unit controls the sewing machine motor irrespective of a height position of the needlebar.

11. The embroidery sewing machine according to claim 7, further comprising a plurality of needlebars and a needlebar selecting unit which selects any one of the needlebars.

* * * * *